United States Patent [19]

Dick

[11] 4,387,851

[45] Jun. 14, 1983

[54] APPARATUS FOR HEATING AND SPRAYING VISCOUS COATING MATERIAL

[76] Inventor: Edward R. Dick, 13609 Larner Rd., Chesanning, Mich. 48616

[21] Appl. No.: 264,278

[22] Filed: May 18, 1981

[51] Int. Cl.[3] ..... B05B 1/24

[52] U.S. Cl. ..... 239/135; 122/26; 137/899.4; 222/146 H; 239/124

[58] Field of Search ..... 137/334; 122/26; 222/146 H; 239/124, 126, 127, 128, 135, 13

[56] References Cited

U.S. PATENT DOCUMENTS

| | | | |
|---|---|---|---|
| 1,277,269 | 8/1918 | Sturcke | 239/13 |
| 3,246,845 | 4/1966 | Techler et al. | 239/124 |
| 3,813,036 | 5/1974 | Lutz | 122/26 X |
| 3,820,718 | 6/1974 | Ammon | 239/135 |

*Primary Examiner*—Andres Kashnikow

*Attorney, Agent, or Firm*—Fisher, Gerhardt, Crampton & Groh

[57] ABSTRACT

An improved apparatus for projecting a viscous coating material onto a surface whereby a constant pressure pump propels a viscous coating material, such as tar, pitch, oil or the like, through a high-pressure relief valve to a spray gun or wand. The rapid flow of the material through the restricted orifice of the relief valve produces sufficient friction to heat the viscous material thereby reducing the viscosity and rendering it easier to apply. A secondary relief valve is provided to reduce any excess pressure that develops and to recirculate any unused material to a supply resevoir.

3 Claims, 3 Drawing Figures

APPARATUS FOR HEATING AND SPRAYING VISCOUS COATING MATERIAL

This invention relates to an apparatus for heating and spraying viscous coating materials. More particularly, it relates to an improved, portable apparatus for reducing a normally viscous coating material such as tar, pitch, oil or the like, to a more fluid state and applying it to a particular surface at a rapid and uniform rate. The uses of the invention include waterproofing cement foundations, providing asphalt sealer for driveways, damproofing basements and spraying tar on roofs. It is particularly useful when the ambient temperature is low, or at work sites where electricity is not available.

Viscuous coating materials, such as tar, pitch, oil or the like, are commonly used by industry and homeowners alike to seal or weatherproof porous or semiporous surfaces. The very nature of these substances requires the use of heat to prevent the material from "freezing" when it is being applied to a particular surface with mops and brushes. A number of devices attempt to eliminate this time-consuming process and to increase the amount of surface area that can be covered.

The disadvantages of these devices are that they are complex and cumbersome to use and all require either an open flame or separate electric or oil burning elements to prevent the materials from solidifying within the device, and to permit fast and even distribution.

It is an object of this invention to provide an apparatus for heating and spraying viscous coating materials without the use of an open flame.

It is another object of this invention to provide an apparatus for heating and spraying viscous coating materials that eliminates the need for a separate, potentially dangerous and energy-consuming, electric or oil burning element.

It is a further object of this invention to provide an apparatus for heating and spraying viscous coating materials, such as tar, pitch, oil or the like, in which the temperature of the spray material can be easily increased or decreased, either before or during the application.

It is still another object of this invention to provide an apparatus for heating and spraying viscous coating materials onto a surface at a rate between 125 and 150 square feet per minute.

It is still another object of this invention to provide a portable self-contained apparatus for heating and spraying viscous coating materials that can be easily transported and used at isolated work sites where electricity is not yet available.

It is yet another object of this invention to produce an efficient, effective, economic and portable apparatus for heating and spraying viscous coating materials onto a surface.

The objects of this invention are accomplished by providing an apparatus that uses a constant pressure pump to propel a viscous coating material such as tar, pitch, oil or the like through a high pressure relief valve to a spray gun or wand. The rapid flow of the material through the restricted orifice of the relief valve produces sufficient friction to heat the viscous material thereby reducing the viscosity and rendering it easier to apply. The temperature of the substance can be preselected before operation or it can be adjusted during the actual spraying by means of a screw device within the high pressure relief valve that controls the size of the valve opening. A secondary relief valve is provided to reduce any excess pressure that develops and to recirculate any unused material to a support reservoir.

These and other objects of the invention will be apparent from the following description and from the drawings in which.

Figure 1:
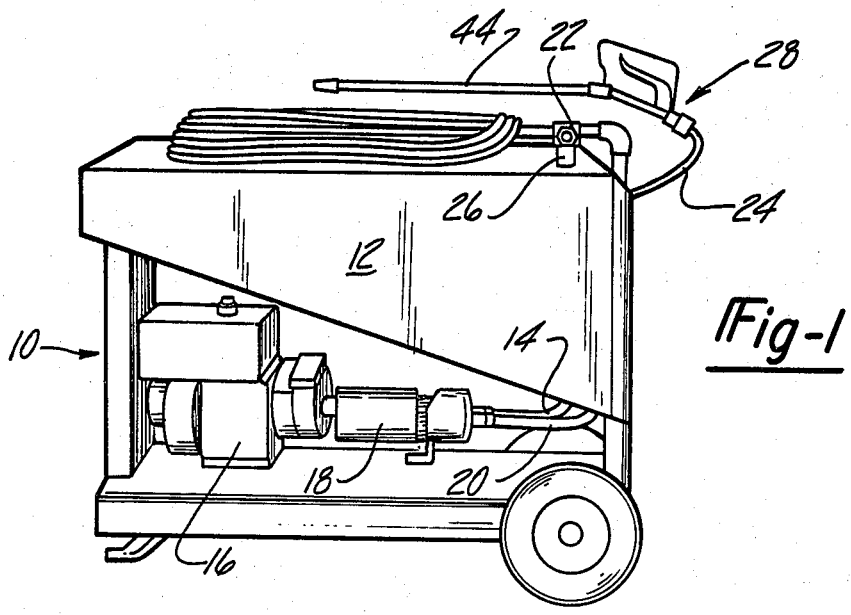
FIG. 1 is a general perspective of the apparatus embodying the present invention in a practical form as used by an operator at a building site.
Figure 2:
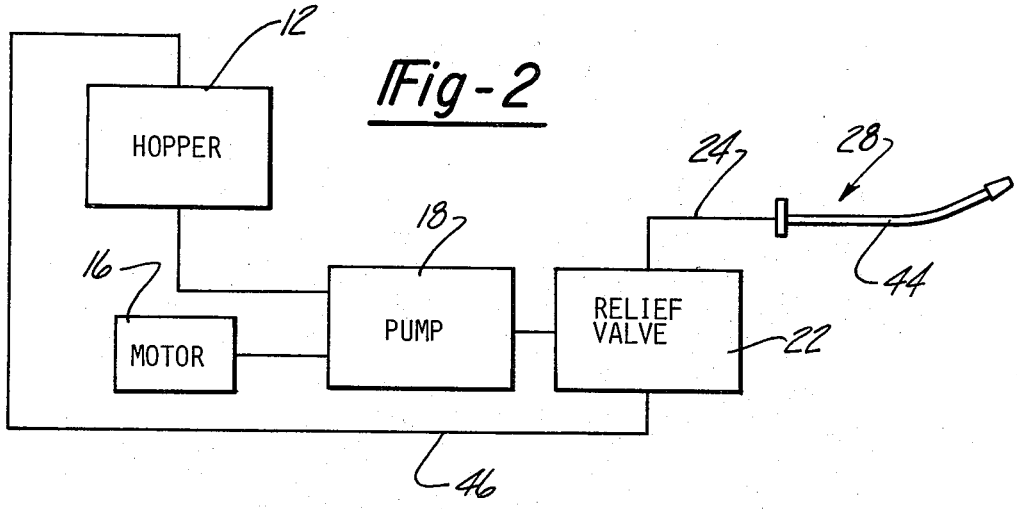
FIG. 2 is a block diagram of the invention showing the relative positions of the components of the invention.

Referring first to FIGS. 1 and 2, one embodiment of the invention shows the components of the apparatus mounted on a portable cart 10 for maneuverability and ease of transportation to the work site.

While the supply reservoir can be in any form, it is shown in FIG. 1 as a covered hopper 12. The hopper 12 is designed so that the viscous coating material, such as tar, pitch, oil or the like, contained therein can flow, preferably by gravity, through a line or hose 14 to a constant pressure pump 18, preferably a hydraulic gear pump. The pump 18, driven by a suitable power device, such as an eight-horsepower electric or gas motor 16, propels the material through a line or hose 20 to a high pressure relief valve 22, which acts as a heating device for the viscous coating material. By way of example the relief valve is shown as mounted on and parallel to the upper horizontal surface of the hopper 12, although other positions can be envisioned.

Figure 3:
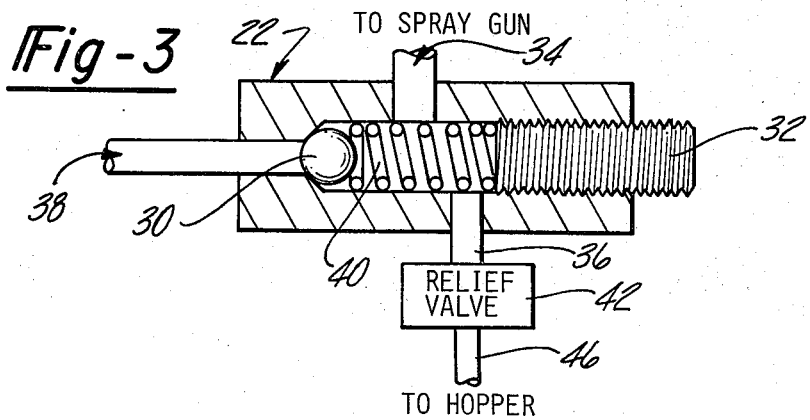
FIG. 3 is a cross section of one embodiment of a high pressure relief valve used as a heating means in the invention, and also the position of the secondary relief valve relative to the primary relief valve.

One embodiment of the high pressure relief valve 22 is shown in cross-section in FIG. 3. As the viscous coating material is propelled through the line or hose 20 to the inlet 38 of the relief valve 22 it encounters a valve ball 30 urged to a closed position by a spring 40. When the fluid pressure at the valve inlet overcomes the resistance of spring 40, the coating material under pressure will be forced through the valve 22 and out the primary valve outlet 34. As the viscous material is forced through the restricted orifice created by the partially open relief valve, sufficient friction is produced to raise the temperature and reduce the viscosity of the coating material. As the now hot and more fluid coating material flows out the valve outlet 34 it passes by way of a flexible hose or conduit 24 to a spray gun or wand 28.

A suitable adjusting screw 32 may be provided to adjust the tension of the spring 40. As the fluid pressure against the valve ball 30 is relatively constant, the amount the valve is opened can be controlled by the tension in the spring. Thus, restricting the opening in the valve by increasing the tension in the spring will result in an increased flow rate producing more friction and a higher temperature.

While other valves with restricted openings can be used to heat the coating material, the high pressure relief valve 22 as shown in the drawings is preferred.

When the spray gun or wand 28 is not in use, or if the fluid pressure within the relief valve 22 is too high, a secondary valve outlet 36 and a secondary relief valve 42 are provided to bleed off any excess pressure and return any unused coating material via a line or hose 46 to the hopper 12.

Although the drawings show but one type of spray gun or wand 28 it is conceivable that other spray guns can be connected with and served by the high pressure relief valve 22 and the pump 18. The preferred spray wand 28 is provided with a nozzle 44 of sufficient length to reach normally inaccessible surfaces and to prevent blow back of the now hot coating material onto the user.

In operation the apparatus embodying the present invention can easily be transported to the work site by means of a portable cart 10. After the hopper 12 is filled with a suitable viscous coating material, such as tar, pitch, oil or the like, a gas motor 16 or other power device can be switched on to drive the preferred hydraulic gear pump 18. The coating material, gravity fed into the pump by way of a line or hose 14, is propelled through the line or hose 20 at a constant pressure to a high pressure relief valve 22. The valve, normally closed by a spring biased valve ball 30, will open when the fluid pressure at the valve inlet 38 exceeds the pressure exerted by the spring 40. The friction produced by the viscous coating material being forced through the restricted valve opening will heat the coating material reducing it to a more fluid state. The now hot coating material is then propelled out the primary valve outlet 34, through a flexible hose or conduit 24 to a spray wand 28.

An adjusting screw 32 in the high pressure relief valve 22 may be used to adjust the tension of the spring and thereby the temperature of the coating material. The valve and adjusting screw are easily accessible to the user so that a predetermined temperature can be selected before operation of the apparatus or the temperature can be varied during operation.

If the spray gun 28 is not being used, the coating material is recirculated to the hopper 12 by way of a secondary valve outlet in the high pressure relief valve 22 and a secondary relief valve 42.

With the particular embodiment of the invention I have presented, the apparatus is capable of spraying hot coating material onto a surface at a rate of 125 to 150 square feet per minute.

While one embodiment of the present invention shows the high pressure relief valve used to heat the coating material mounted on or near the hopper 12, it is conceivable that the relief valve can be mounted in or near the spray gun itself.

While there is described above the principals of this invention in connection with a specific apparatus, it is to be clearly understood that this description is made only by way of example and not as a limitation to the scope of this invention.

The embodiments of the invention in which an exclusive property or privilege is claimed are defined as follows:

1. A self-contained mobile apparatus for distributing a viscous coating material onto a surface to be coated, comprising: a supply reservoir for holding said material, heating means for heating said material and decreasing its viscosity, a gear pump having an intake communicating with said supply reservoir and an outlet communicating with said heating means, said heating means including a high pressure relief valve having a moveable ball valve and spring action on said ball valve to urge said ball valve toward a closed position, screw means acting on said spring for adjusting the tension and the load exerted by said spring to a predetermined value, said valve means being moveable from a closed position in response to fluid pressure at said pump outlet exerting a force in excess of the opposing force exerted on said ball by said spring whereby the heat of friction due to the flow of the viscous material through the open valve reduces the viscosity of said material, said heating means including an outlet downstream of said valve means communicating with a flexible conduit connected to a selectively operable spray gun to dispense material to the surface to be coated.

2. The apparatus of claim 1 and further comprising an additional outlet downstream of said valve means communicating with said supply reservoir to return excess material when said spray gun is not operating.

3. The apparatus of claim 2 wherein said heating means is supported on said supply reservoir and wherein said additional outlet communicates directly with said supply reservoir.

* * * * *

UNITED STATES PATENT AND TRADEMARK OFFICE

CERTIFICATE OF CORRECTION

PATENT NO. : 4,387,851

DATED : May 18, 1981

INVENTOR(S) : EDWARD R. DICK

It is certified that error appears in the above—identified patent and that said Letters Patent is hereby corrected as shown below:

Column 2, line 3, after "a", "support" should read --supply--.

Signed and Sealed this

*Eighth* Day of *November 1983*

[SEAL]

*Attest:*

GERALD J. MOSSINGHOFF

*Attesting Officer*

*Commissioner of Patents and Trademarks*